US005435157A

United States Patent [19]

Laughlin

[11] Patent Number: 5,435,157

[45] Date of Patent: Jul. 25, 1995

[54] LAUNDRY CHEMICAL DISPENSER

[75] Inventor: Timothy E. Laughlin, Edina, Minn.

[73] Assignee: Sunburst Chemicals, Inc., Minneapolis, Minn.

[21] Appl. No.: 188,149

[22] Filed: Jan. 27, 1994

[51] Int. Cl.[6] ..... D06F 39/02

[52] U.S. Cl. ..... 68/17 R; 137/889; 137/893; 222/132

[58] Field of Search ..... 68/12, 18, 17 R; 134/93, 99.2; 222/132, 133; 137/889, 893, 597

[56] References Cited

U.S. PATENT DOCUMENTS

| | | | |
|---|---|---|---|
| 1,954,261 | 4/1934 | Pierce . | |
| 2,308,612 | 1/1943 | Lehmkuhl . | |
| 2,371,720 | 3/1945 | Stine . | |
| 2,605,708 | 8/1952 | Smedes | 222/133 X |
| 2,802,724 | 8/1957 | Johnson . | |
| 3,044,285 | 7/1962 | Koplin . | |
| 3,160,317 | 12/1964 | Hambro . | |
| 3,219,050 | 11/1965 | Ericson . | |
| 3,229,709 | 1/1966 | Gerken . | |
| 3,319,637 | 5/1967 | Gore et al. . | |
| 3,595,438 | 7/1971 | Daley et al. . | |
| 3,680,070 | 7/1972 | Nystuen . | |
| 3,727,889 | 4/1973 | Nagel . | |
| 3,771,333 | 11/1973 | Jurjans . | |
| 3,816,427 | 6/1974 | Loliger et al. . | |
| 3,850,344 | 11/1974 | Burge et al. . | |
| 3,881,328 | 5/1975 | Kleimola et al. | 68/12.18 |
| 3,891,123 | 6/1975 | Blackburn . | |
| 4,020,865 | 5/1977 | Moffat et al. . | |
| 4,063,663 | 12/1977 | Larson et al. . | |
| 4,103,520 | 8/1978 | Jarvis et al. | 68/12.18 |
| 4,357,953 | 11/1982 | Patterson . | |
| 4,426,362 | 1/1984 | Copeland et al. . | |
| 4,444,730 | 4/1984 | Renders et al. . | |
| 4,463,582 | 8/1984 | Saumann et al. . | |
| 4,687,121 | 8/1987 | Copeland . | |
| 4,691,850 | 9/1987 | Kirschmann et al. . | |
| 4,845,965 | 6/1989 | Copeland et al. . | |
| 5,014,211 | 5/1991 | Turner et al. | 68/17 R X |

FOREIGN PATENT DOCUMENTS

| | | | |
|---|---|---|---|
| 848799 | 8/1970 | Canada | 222/132 |

*Primary Examiner*—Philip R. Coe
*Attorney, Agent, or Firm*—Patterson & Keough

[57] ABSTRACT

The present invention is a chemical dispenser for use in servicing at least two laundry cleaning machines to dispense a plurality of chemical agents utilized in the process of cleaning soiled laundry, wherein at least two of the chemical agents are compatible. The chemical dispenser has a plurality of chemical dispensing systems designed to deliver a selected chemical agent from a source to a washing machine. A chemical dispensing system is in flow communication with each chemical source and in flow communication with each washing machine. Each chemical dispensing system has a pump and a delivery conduit. For selected chemical agent delivery, the pump is a venturi injector pump. The chemical dispensing systems utilized for dispensing compatible chemical agents have a common portion and are fluidly independent from chemical dispensing systems utilized for dispensing incompatible chemical agents.

1 Claim, 4 Drawing Sheets

LAUNDRY CHEMICAL DISPENSER

TECHNICAL FIELD

The present invention relates to an automatic dispenser of laundry chemicals capable of servicing two or more washing machines. More particularly, the present invention utilizes venturi eductors to deliver at least two of the laundry chemicals to the washing machines.

BACKGROUND OF THE INVENTION

The problem of automatically delivering laundry chemicals to washing machines in a commercial setting has long been dealt with by those in the industry. To be successful, such a laundry chemical dispenser must be economical, it must require a minimum of human interaction, and it must deliver, at different times, incompatible chemical agents.

Typically, three types of chemical agents are utilized in a wash cycle. These include a detergent, a sour/softener or souring agent, and a bleach. The detergent is alkaline, the sour/softener is acidic, and the bleach is a compound that contains chlorine. The detergent and the bleach are compatible chemicals. The sour/softener and the bleach are incompatible chemical agents. If the acidic sour/softener comes into contact with the bleach, toxic chlorine gas can form. Accordingly, care must be taken that the bleach and the sour/softener not be mixed together.

A great deal of work has been done in the past to design an automatic chemical agent dispensing system for use with multiple washing machines. An example of the designs emanating from such work is U.S. Pat. No. 3,160,317. The '317 is an electrically controlled, pneumatically operated system for servicing multiple washers. The '317 patent has multiple mechanical pumps for delivering a detergent and an alkali mix through independent plumbing to the washers. A key feature of the '317 patent is that it mixes a liquid silicate with a liquid caustic on site to make the alkali mix that is delivered to the washing machines.

A second design of a chemical dispenser utilized to dispense potentially incompatible chemicals is that contained in U.S. Pat. No. 4,691,850. The '850 patent has a single electric pump that draws liquid from a manifold. The manifold has multiple lines connected to various liquid chemicals. After dispensing a single chemical, a water flush cycle is initiated in order to flush the manifold and the pump to remove any traces of a chemical that may be incompatible with the succeeding chemical that is to be dispensed.

Another example of a chemical dispenser is that detailed in U.S. Pat. No. 4,845,965. The device of the '965 patent was designed to utilize a single common delivery system for each of the chemicals, even though such chemicals may be incompatible. In order to accomplish this, the '965 patent incorporates a rather complex flushing system that provides for a water flush of all common lines and sumps after the delivery of a specific chemical. The '317, '850, and '965 patents do not teach the use of common components for the delivery compatible chemical agents nor do they teach the use of pumps that deliver chemical agents by means of venturi action.

It would be beneficial to the industry to solve the aforementioned problems. A solution should include simple, reliable components. Additionally, the number of components should be minimized by incorporating commonality for the delivery of compatible chemicals.

SUMMARY OF THE INVENTION

The present invention solves the aforementioned problems in the following ways. The invention uses simple, economical venturi injector pumps to deliver the detergent and sour/softener agents to the washing machines. Such pumps have no moving parts and require as a motive force only the flow of water under pressure. The rate of flow and pressure that is commonly available at the tap is adequate to generate the pumping action of the venturi injectors. The present invention additionally employs commonality of components for compatible chemical agent delivery. Accordingly, a single conduit between the chemical dispenser and each washing machine is provided to deliver both bleach and detergent since those two chemical agents are compatible. An independent conduit is provided to deliver the sour/softener to each of the washing machines since the sour/softener and the bleach are not compatible. By providing this split system, the present invention does away with the need for complex flushing systems, since no portion of the delivery system for the bleach is common with the delivery system for the sour/softener. This provides a certainty that no dangerous chlorine gas is formed. Finally, the present invention is fully automated, thereby minimizing the human intervention required to perform the laundry water function.

The present invention is a chemical dispenser for use in servicing at least two laundry cleaning machines to dispense a plurality of chemical agents utilized in the process of cleaning soiled laundry, wherein at least two of the chemical agents are compatible. The chemical dispenser has a plurality of chemical dispensing systems designed to deliver a selected chemical agent from a source to a washing machine. The chemical dispenser comprises a controller for controlling the dispensation of chemicals to washing machines which is communicatively coupled to each of said washing machines and receives signals therefrom. The controller is also communicatively coupled to the chemical dispensing systems to provide commands thereto responsive to the received signals. These commands configure the chemical dispensing systems properly in order to dispense and withhold selected chemicals as desired.

A chemical dispensing system is in flow communication with each chemical source and in flow communication with each washing machine. Each chemical dispensing system has a pump and a delivery conduit. For selected chemical agent delivery, the pump is a venturi injector type pump. The chemical dispensing systems utilized for dispensing compatible chemical agents have a common portion and are fluidly independent from chemical dispensing systems utilized for dispensing incompatible chemical agents.

DETAILED DESCRIPTION OF THE DRAWINGS

Figure 1:
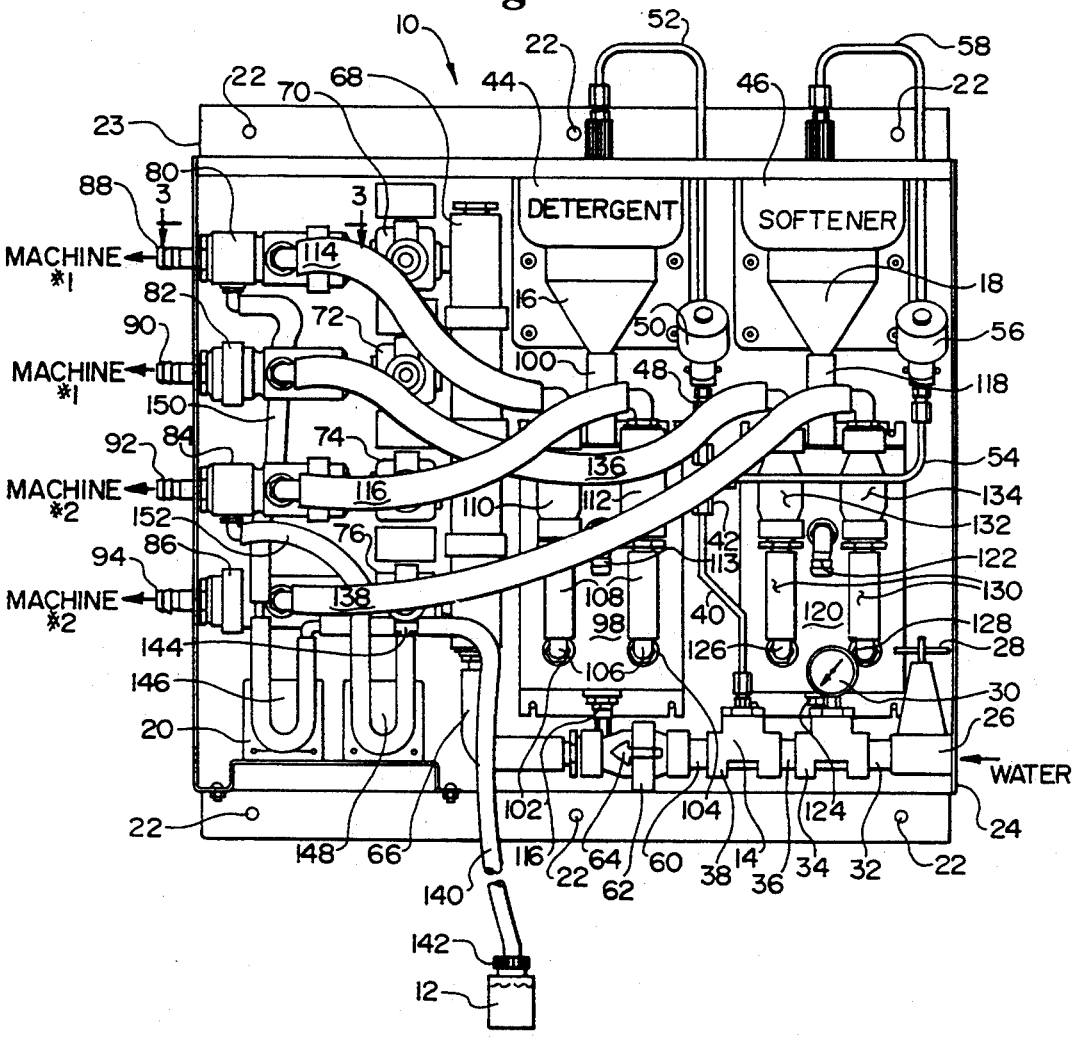
FIG. 1 is a side elevational view of the present invention with the exterior cover removed to reveal the inner components.

The detergent dispenser of the present invention is shown generally at 10 in FIG. 1. Dispenser 10 is designed to dispense a detergent and a sour/softener that are supplied in a solid cast form. In this form, the detergent and sour/softener are each cast as a solid, typically in large mouthed, plastic containers. The advantage of such solid cast chemicals is that they are safe to transport, in that they do not spill and mix in the event of an accident, and there is the advantage of elimination of the transportation costs associated with transporting very heavy liquids. To deliver such solid cast chemical agents to a washing machine, the containers are inverted with the mouths facing downward and a upwardly directed spray of water is applied to the chemicals to dissolve them into liquid solution that is suitable for pumping and delivery via flexible conduits. This is shown schematically in FIG. 4, and will be later explained in more detail.

Returning to FIG. 1, the bleach that is supplied by dispenser 10 to the washing machine is in liquid form. The bleach is typically contained in a large container that is separate from dispenser 10. This container is preferably located near dispenser 10 to facilitate the withdrawal of bleach therefrom. In practice it is desirable that container 12 be located on the floor directly beneath dispenser 10. The bleach container 12 is shown schematically in reduced form in FIG. 1.

Chemical dispenser 10 has four major systems all under control of a controller (not shown). The four major systems are the water system 14 and the three chemical agent delivery systems; the detergent delivery system 16, the sour/softener delivery system 18, and the bleach delivery system 20. The dispenser 10 is typically wall mounted utilizing conventional fasteners such as screws or lag bolts. The screws penetrate bores 22 and fasten dispenser 10 to a wall in the proximity of the washing machines. Bores 22 are formed in surfaces of the housing 23 of dispenser 10 that are formed parallel to the wall surface.

Dispenser 10 is preferably located approximate a sink that has a source of both hot and cold tap water and a drain. The water system 14 has a inlet port 24 located in the side of housing 23 of dispenser 10. Tap water of known temperature and pressure is inletted through port 24. The pressure of the incoming water is controlled to a desired level by pressure regulator 26. Pressure regulator 26 is manually set using control handle 28. Such setting is typically performed one time during the installation of dispenser 10 at the site in which the dispenser is to operate. Subsequent adjustments are typically not needed assuming that the temperature and pressure of the tap water remains relatively constant. The pressure is set to the desired level by the installer by viewing pressure gauge 30.

Water entering dispenser 10 is used to perform two main functions. The first is to dissolve the solid cast chemical agents and the second is to provide motive force through the venturi injectors to deliver the selected chemicals to the washing machines. Accordingly, water is relayed from regulator 26 through conduit 32, T fitting 34 (T fitting 34 provides a convenient source of water pressure to gage 30) and conduit 36 to T fitting 38. At T fitting 38, the water is split into two different paths. The first path is utilized for solid cast chemical agent dissolution. The water in the chemical dissolution path is conveyed from T fitting 38 by conduit 40. The conduit 40 enters a T fitting 42. T fitting 42 further splits the chemical dissolution path of the water to provide a source of water to the detergent dissolution bowl 44 and the sour/softener dissolution bowl 46. Accordingly, a first branch of T fitting 42 is connected to conduit 48. Conduit 48 is in turn connected to solenoid valve 50. Solenoid valve 50 is electrically connected to the control system of dispenser 10 and under the control of such control system to selectively supply water to detergent dissolution bowl 44. After passing solenoid valve 50, the water is conveyed via conduit 52 to detergent dissolution bowl 44.

The second branch leading from T fitting 42 is a water path that is similar to the aforementioned water path, except that the second branch serves sour/softener dissolution bowl 46. Accordingly, the second branch is comprised of a conduit 54 that leads to a solenoid valve 56 and a conduit 58 that connects solenoid valve 56 to the sour/softener dissolution bowl 46. Solenoid valve 56 is electrically connected to the control system of dispenser 10 and under the control of such control system to selectively supply water to sour/softener dissolution bowl 46.

The dissolution bowls 44, 46 are commercially available items that may be procured from Viking Industries. The bowls 44, 46 are preferably a hard molded plastic material that is selected to be non-reactive with the selected chemical agents. Bowls 44, 46 have an upper bowl portion to support the inverted solid cast chemical container, an upwardly directed nozzle to spray water on the chemical agent, and a lower bowl portion to capture the dissolved chemical agent.

The water that provides the motive force for the venturi injector pumps is conveyed by conduit 60 from T fitting 38. Conduit 60 is in turn connected to check valve 62. Check valve 62 is a one-way valve that permits flow only in the direction of arrow 64, thus, preventing back flow of chemical agents into the previously described components of water system 14.

The water is conveyed from check valve 62 via conduit 66 to manifold 68. Manifold 68 is in turn connected via short conduits to four solenoid valves 70, 72, 74 and 76. Solenoid valves 70–76 are electrically connected to the control system of dispenser 10 for selectively passing a stream of water from manifold 68 to a selected venturi injector.

Solenoid valves 70–76 are connected via short conduits (not shown) to venturi injectors 80, 82, 84 and 86. Each such venturi injector 80–86, has a discharge port 88, 90, 92, and 94 for the discharge of water and any chemicals as selected passing therethrough.

The detergent delivery system 16 is comprised of four major components; the dissolution bowl 44, the sump 98, and the venturi-injectors 88 and 92, as well as interconnecting associated plumbing.

Dissolved detergent is conveyed in solution by gravity feed from bowl 44 through conduit 100 to sump 98. Sump 98 is a substantially enclosed container that is utilized to accumulate detergent in solution prior to providing such detergent to a washing machine. Sump 98 has an overflow opening 114. Overflow opening 114 is preferably connected to suitable flexible tubing (not shown), which is brought outside of dispenser 10 and fluidly coupled to a drain for the disposal of excess detergent solution.

Sump 98 has two removal ports 102, 104 located near the bottom of sump 98 that are utilized for the removal of detergent solution from sump 98. A conductivity probe 116 is located in the bottom of sump 98 and electrically connected to the control system of dispenser 10. The sensor of conductivity probe 116 is emersed in the detergent solution. The conductivity sensed by conductivity probe 116 is an indication of the presence or absence of detergent solution within sump 98. Accordingly, the output of the conductivity probe 116 is utilized as an indication of the absence of detergent to an operator so that the operator can initiate corrective action.

Removal ports 102, 104 are connected via elbows 106 to conduits 108. The conduits 108 are in turn connected to check valves 110, 112. Check valves 110, 112 provide for flow only in the upward direction. Check valves 110, 112 function to prevent back flow of detergent into sump 98. Check valve 110 is connected via conduit 114 to then venturi injector 88. Check valve 112 is connected via conduit 116 to venturi injector 92.

Sour/softener delivery system 16 includes components that are similar in design and function to the components of detergent delivery system 16. The sour/softener solution is conveyed by conduit 118 by gravity from bowl 46 to sump 120. Sump 120 is designed to be interchangeable with sump 98. Sump 120 has a overflow outlet 122 that is connected by a conduit (not shown) that is directed to the vicinity of a drain for disposal of excess sour/softener solution. Additionally, sump 120 has a conductivity sensor 124 located in the bottom thereof. Conductivity sensor 124 is electrically connected to the control system of dispenser 10. Conductivity sensor 124 is utilized to measure the conductivity of the sour/softener solution present in sump 120 and thereby give an indication of the presence or absence of such solution in sump 120 to an operator.

Sump 120 has removal ports 126, 128 located near the bottom of sump 120 for the removal of sour/softener solution therefrom. Removal ports 126, 128 are connected via conduits 130 to check valves 132, 134. Check valves 132, 134 are one way valves that permit fluid flow in the upward direction only, as depicted in FIG. 1. This prevents the back flow of sour/softener solution into sump 120. Check valve 132 is connected via conduit 136 to venturi injector 82. Check valve 134 is connected via conduit 138 to venturi injector 86.

The final subsystem of chemical dispenser 10 is the bleach delivery system 20. As previously indicated, the bleach is provided in liquid form to dispenser 10. A conduit 140 is typically fed into an opening in the cap 142 of the bleach container 12. The end of conduit 140 is then positioned proximate the bottom of container 12. The other end of conduit 140 is connected to a T fitting 144. T fitting 144 divides the bleach flow from container 12, sending the bleach to two peristaltic pumps 146, 148.

The peristaltic pumps 146, 148 are electromechanical devices that are commercially available components. Peristaltic pump 146 is connected by conduit 150 to venturi injector 80. Peristaltic pump 148 is connected by conduit 152 to venturi injector 84. Operation of either peristaltic pump 146 or 148 withdraws bleach from container 12 and provides the bleach to venturi injectors 80, 84 respectively for discharge to the washing machines through conduits that are commonly used for both the bleach and the detergent.

Figure 2:
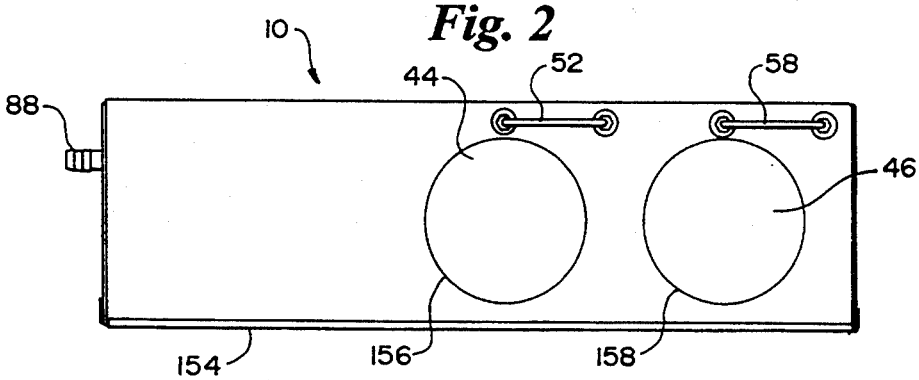
FIG. 2 is a top elevational view of the present invention with the front cover in place.

FIG. 2 is a depiction of the top of chemical dispenser 10. FIG. 2 illustrates the top edge of front cover 154 of dispenser 10. Cover 154 fully encloses the components illustrated in FIG. 1. FIG. 2 additionally shows openings 156, 158. Opening 156 opens into detergent dissolution bowl 44. In loading detergent into chemical dispenser 10, the detergent container is opened and inverted and then inserted into opening 156 in the mouth down position. The solid cast detergent remains in a homogeneous block within the container. Opening 158 opens into sour/softener dissolution bowl 46. The solid cast sour/softener is loaded in a manner similar to the previously described loading of the detergent.

Figure 3:
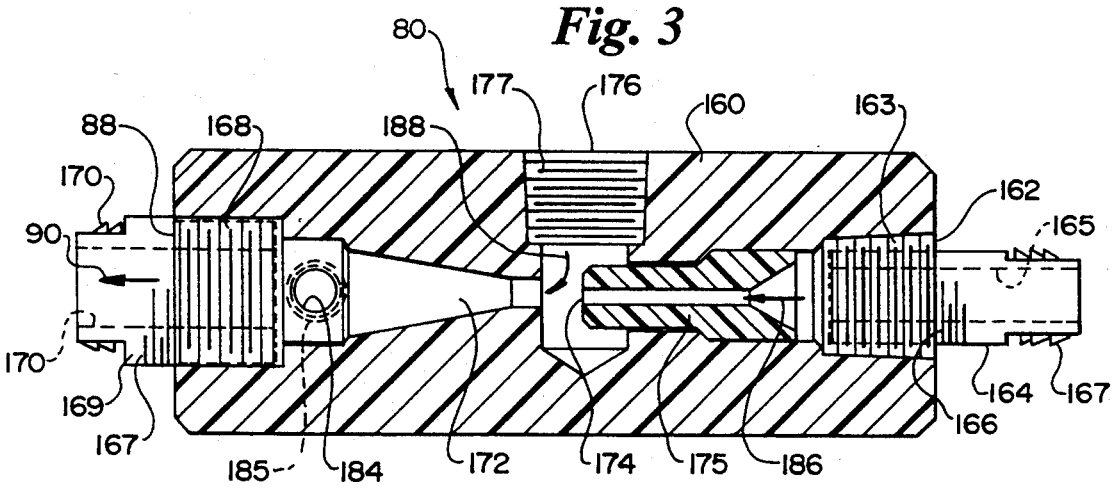
FIG. 3 is a sectional side view of a venturi injector taken along line 3—3 in FIG. 1.

A sectional view of venturi injector 80 as depicted in FIG. 3. The four venturi injectors 80, 82, 84 and 86 are all identical in interior construction. Accordingly, the following description of venturi injector 80 is applicable to the other three venturi injectors 82, 84, and 86 utilized in chemical dispenser 10.

Venturi injector 80 has a body 160 that is preferably formed of a polycarbonate material. Such materials are chosen for their ease in formation, inertness with respect to the chemical agents to be dispensed, and ease with which such materials may be milled and bored to form the necessary fluid passageways therethrough. It is understood that venturi injector 80 could also be constructed of other types of materials such as metallic materials.

Venturi injector 80 has an inlet port 162. Inlet port 162 has internal threads 163 milled therein. Inlet connector 164 has an interior fluid passageway 165 (shown in phantom) that is fluidly connected to inlet port 162. Inlet connector 164 is formed with a first end having exterior threads 166 that match the interior threads 163 of inlet port 162. The second end of inlet connector 164 is formed with flutes 167 that provide for a strong gripping and sealing engagement with a flexible conduit.

Venturi injector 80 has a discharge port 88. Discharge port 88 has internal threads 168 milled therein. A discharge connector 169 is designed to mate with the internal threads 168 of exit port 88. The discharge connector is of similar design to the inlet connector 164. Accordingly, discharge connector 168 has exterior threads 167 formed at a first end that are engagement with the threads 168 of discharge port 88. The second end of the discharge connector 168 has flutes 170 to insure a tight gripping and sealing engagement with a flexible conduit. Discharge connector 169 is adapted to be connected to a conduit (not shown) that is further connected to a chemical inlet of the washer number one for conveyance of chemical agent from the venturi injector 80 to the washer number one.

Inlet connector 164 and discharge connector 169 have interior fluid passageways 165, 170 respectively formed therein. Fluid passageways 165, 170 are depicted in phantom. Fluid passageways 165, 170 are fluidly connected through venturi passageway 172 formed internal to the body 160 of venturi injector 80. Venturi passageway 172 has a gradually decreasing diameter from inlet port 162 to throat 174. Thereafter, venturi passageway 172 has a gradually expanding diameter outward to discharge port 88. In a preferred embodiment, throat body 175 is formed separate from body 160 and is press fitted into venturi passageway 172. An advantage of such construction of throat body 175 is that the size of venturi throat 174 can be varied by changing the design of only venturi body 175. This accommodates the construction of a common body 160 that is used with a variety of venturi bodies 175, having a variety of different sized throats 174.

A first chemical agent passageway 176 is formed in venturi injector 80. Chemical agent passageway 176 intersects venturi passageway 172 proximate throat 174. Passageway 176 has interior threads 177 designed to engage a connector (not shown) of similar construction to inlet connector 164.

A second chemical agent passageway 184 intersects venturi passageway 172 between throat 174 and exit port 88. Passageway 184 has interior threads 185 designed to engage a connector (not shown) that is of similar design and construction as inlet connector 164. As seen in FIG. 1, venturi injectors 80 and 84 are utilized for bleach discharge to washing machines numbered one and two. Accordingly, venturi injectors 80, 84 are configured as indicated in FIG. 3 with passageway 184 fluidly coupled to the bleach container 12. Venturi injectors 82 and 86 are utilized to deliver only a single chemical agent. Venturi injectors 84, 86 are formed identical to venturi injectors 80, 84, but have a solid plug (not shown) threaded into body 160 at second chemical agent passageway 184. The solid plug (not shown) effectively seals second chemical agent passageway 184. Since passageway 184 is downstream of venturi throat 174, this does not affect the pumping action of the venturi on the first chemical agent that enters passageway 176.

Flow through injector 80 is as indicated by arrows 186, 188, and 190. Water under pressure flows into venturi injector 80 as indicated by arrow 186. As the flow of the water under pressure accelerates through throat 174, it creates a low pressure area that generates a suction force that draws the chemical agent, in this case the detergent solution, from the sump 98 through passageway 176 and into venturi passageway 172 as indicated by arrow 188. The detergent solution, diluted by the water passing through throat 174 proceeds out discharge port 88 as indicated by arrow 190 to be conveyed to the washing machine.

A second chemical agent (bleach) may be introduced to the venturi passageway 172 at passageway 184. Second chemical agent passageway 184 is far enough down stream of throat 174 that water flow through throat 174 does not exert a drawing influence on such second chemical agent. The motive force for the second chemical agent is provided then by peristaltic pumps 146, 148. The second chemical agent is diluted by the water flowing through throat 174 and is discharged from venturi injector 80 at port 88 as indicated by arrow 190 and conveyed to the washer by means of a flexible conduit. The portion of injector 80 downstream of passageway 184 and the flexible conduit are common delivery vehicles for both the detergent and the bleach.

Figure 4:
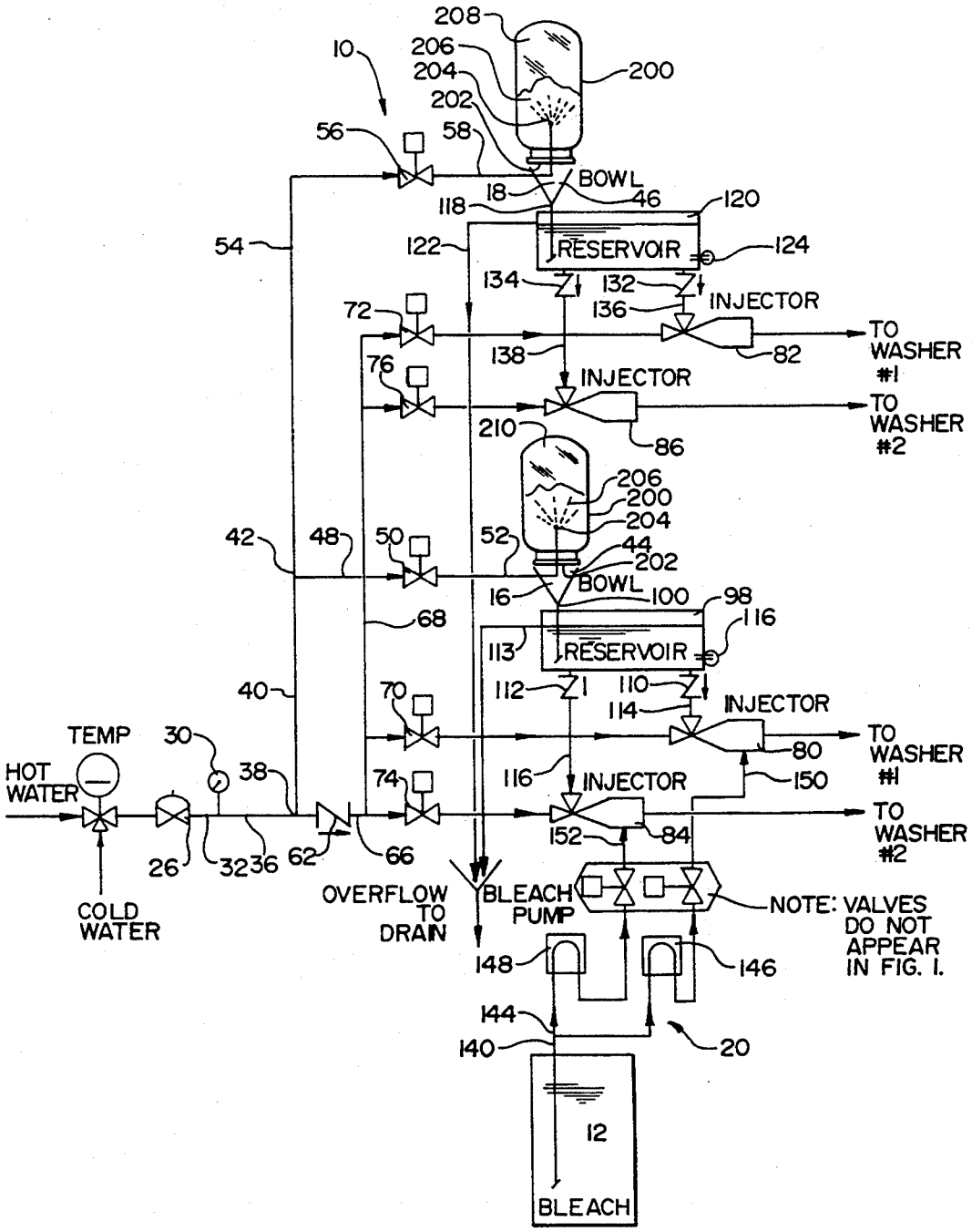
FIG. 4 is a schematic diagram of the present invention.

FIG. 4 is a schematic diagram of chemical dispenser 10. The numerals utilized in FIG. 4 correspond to like components illustrated in FIG. 1. FIG. 4 is useful in illustrating the fluid flows prevalent in chemical dispenser 10, including the dry cast chemical agent containers 200. The dry cast chemical agent containers 200 are depicted schematically in FIG. 4. Containers 200 are shown inverted in both bowls 44, 46. A nozzle 204 is inserted upward through mouth 202 of container 200. A water spray 206 emanating from nozzles 204 of bowls 44, 46 impinges upon solid cast sour/softener 208 and solid cast detergent 210, respectively contained therein. The water spray 206 acts to erode and dissolve solid cast sour/softener 208 and solid cast detergent 210. The dissolved chemical agents flow by gravity through conduits 118, 100 to sumps 120, 98, respectively.

Figure 5:
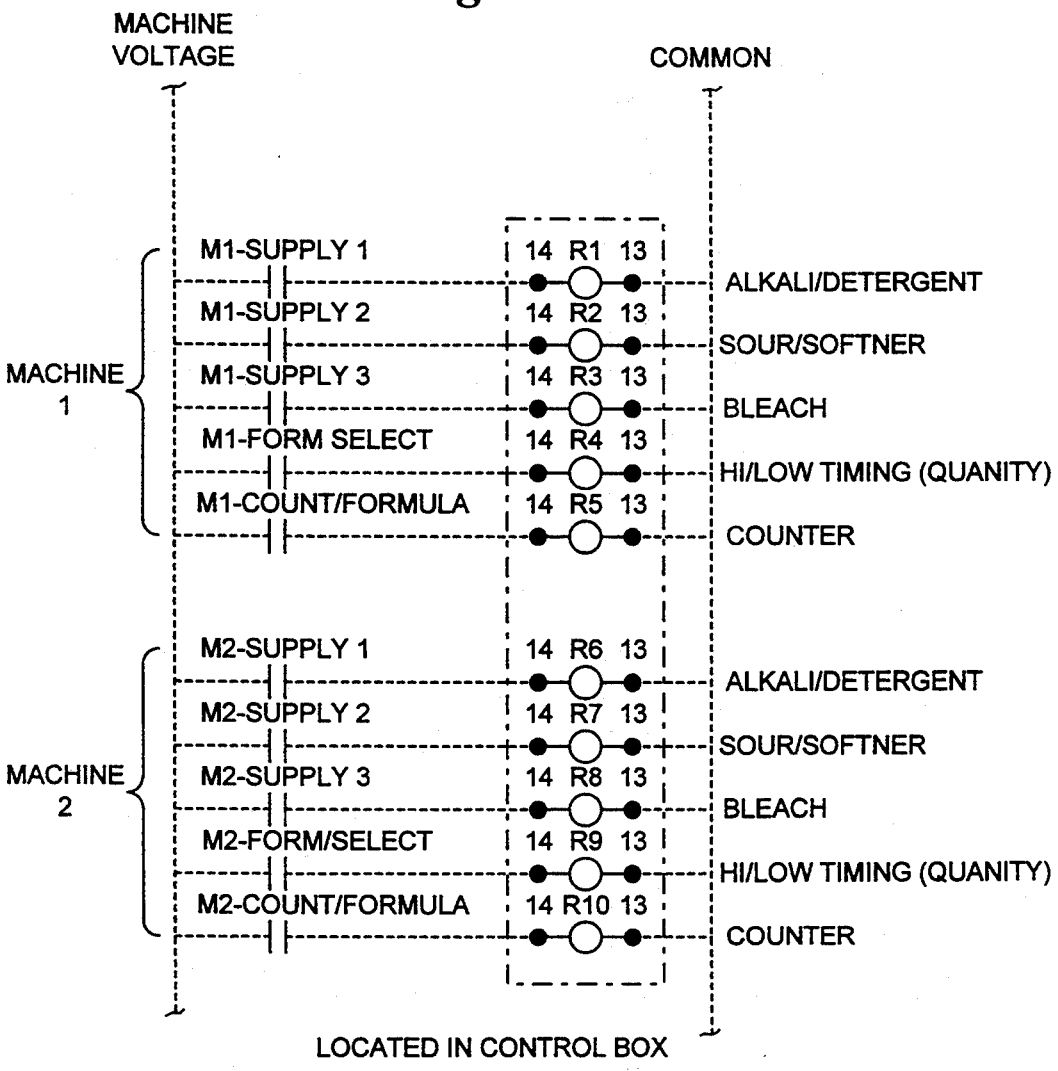
FIG. 5 is an elevational view of a control panel within the control box of the present invention that receives the various signals from the washers that are utilized to initiate the various functions of the present invention.

FIG. 5 is a schematic diagram of signals provided by the first and second washing machines to the control system of the chemical dispenser 10. Responsive to the indicated control signals, the control system configures chemical dispenser 10 to provide the desired chemical agents to the first and second washing machines. Three chemical agents, detergent, sour/softener, and bleach, are called for by the first three signals from each of the two washing machines. The fourth signal is a timing function indicating that the washing machine is set for either a high or low timing periods. The timing function is utilized by the washing machine to account for either light or heavy washing load, with the heavier washing loads requiring greater length of time to the various cleaning cycles. The fifth signal is the counter signal which provides a signal to the control system of chemical dispenser 10 indicating that the wash cycle of the washing machine that sent the signal has completed all cycles for the particular load of laundry.

In operation, when the control system of chemical dispenser 10 receives a detergent command from washer number 1, the control system opens solenoid valves 50 and 70. Water flows through solenoid valve 50 to nozzle 204 of detergent dissolving bowl 44, depicted in FIG. 1 and 4. The spray 206 from nozzle 204 dissolves the dry cast detergent 210 that has been formed in container 200. The dissolved detergent, in a strong concentration, flows from bowl 44 into sump 98.

The water under pressure also flows through solenoid valve 70 to venturi injector 80. The flow of the water through throat 174 of venturi injector 80 draws the dissolved detergent from sump 98. The dissolved detergent is mixed with and diluted by the water passing through throat 174. The diluted detergent is discharged from venturi injector 80 into a conduit that is attached to discharge connector 166 and thence to washer number one. The sour/softener delivery system 18 and the bleach delivery system 20 are disabled by the control system during the time that the detergent is being delivered to the washer number one so that only the chemical agent, in this case the detergent, that was called for by the washing machine is delivered to the washing machine.

When the control system receives a command from washer number one for sour/softener, the control system opens solenoid valves 56 and 72. Water flowing through solenoid valve 56 is emitted from nozzle 204 of bowl 46 as spray 206 which impinges upon solid cast sour/softener 208 contained as a cast block in the container 200. The dissolved, concentrated sour/softener 208 flows from sour/softener dissolution bowl 46 into sump 120. Water flowing through solenoid valve 72, enters venturi injector 82 and flows through throat 174 thereof. The flow through venturi throat 174 draws the dissolved sour/softener from sump 120. The flow of water mixes with the dissolved, concentrated sour/softener, diluting the sour/softener and discharging the sour/softener to washer number one via a conduit that is independent from the previously described conduit that is utilized to convey the detergent to washer number one.

The control system of chemical dispenser 10 responds to a call for bleach from washer number one by opening solenoid valve 70 and turning on peristaltic pump 146.

Peristaltic pump 146 draws the bleach from container 12 and pumps it into venturi injector 80. The bleach is there mixed with and diluted by the water passing through solenoid valve 70 and is discharged from venturi injector 80 to washer number one in the same previously described conduit that conveys the detergent. This commonality of components is possible since the bleach and the detergent are compatible chemicals, whereas the bleach and the sour/softener are incompatible chemicals that could generate a toxic gas when mixed.

The present invention has now been described with reference to several embodiments thereof. It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

I claim:

1. A chemical dispenser for use in servicing at least two laundry cleaning machines to dispense a plurality of chemical agents utilized in the process of cleaning soiled laundry, at least two of the chemical agents being compatible, having a plurality of chemical dispensing systems, each of such chemical dispensing systems being designed to deliver a selected chemical agent from a source to a washing machine, comprising:

control means for controlling the dispensation of chemicals to washing machines, being communicatively coupled to each of said washing machines and receiving signals therefrom and being communicatively coupled to the chemical dispensing systems to provide commands thereto responsive to the received signals, the commands configuring the chemical dispensing systems in order to dispense and withhold selected chemicals; and at least one chemical dispensing system being in flow communication with one incompatible chemical agent source and being in flow communication with a selected washing machine, arid having a pump fluidly coupled to a delivery conduit, the delivery conduit being in flow communication with the selected washing machine; and at least one chemical dispensing system being in flow communication with a plurality of compatible chemical agent sources and being in flow communication with a selected washing machine, and having a pump fluidly coupled to a delivery conduit, the delivery conduit being in flow communication with the selected washing machine, wherein the chemical dispensing systems utilized for dispensing compatible chemical agents have a common chemical agent delivery portion designed to convey compatible chemical agents and are fluidly independent from chemical dispensing systems utilized for dispensing incompatible chemical agents and wherein the pump of at least one of the chemical dispenser systems is comprised of venturi injector means for dispensing a chemical agent, the venturi injector means being comprised of a housing having a central fluid passageway defined therethrough and a throat body having a throat defined therein, the throat body being disposed in the central fluid passageway defined in the housing and having a first intersecting fluid passageway intersecting the central fluid passageway proximate the throat, the central fluid passageway being defined between an inlet port and a discharge port with the throat being disposed between the inlet port and the discharge port and a second intersecting fluid passageway intersecting the central fluid passageway between the throat and the discharge port.

* * * * *